United States Patent [19]

Baird et al.

[11] 4,110,171

[45] Aug. 29, 1978

[54] MECHANICAL JAMB CLEANER

[75] Inventors: William R. Baird, Sturgis; Kenneth O. Sutton, Morganfield; Billy C. Baird, Sullivan, all of Ky.

[73] Assignee: Saturn Machine & Welding Co., Inc., Sturgis, Ky.

[21] Appl. No.: 798,869

[22] Filed: May 20, 1977

[51] Int. Cl.[2] ..... C10B 43/04

[52] U.S. Cl. ..... 202/241; 15/93 A

[58] Field of Search ..... 202/241; 15/93 A

[56] References Cited

U.S. PATENT DOCUMENTS

| | | | |
|---|---|---|---|
| 3,464,074 | 9/1969 | Stanke et al. | 15/93 A |
| 3,681,201 | 8/1972 | McCullough | 202/241 |
| 3,847,753 | 11/1974 | Baird et al. | 202/241 |
| 3,955,232 | 5/1976 | Konno | 202/241 X |
| 3,971,092 | 7/1976 | Stanke et al. | 202/241 X |

*Primary Examiner*—Morris O. Wolk
*Assistant Examiner*—Roger F. Phillips
*Attorney, Agent, or Firm*—Clarence A. O'Brien; Harvey B. Jacobson

[57] ABSTRACT

An upstanding support is provided and a carriage is mounted on the support for vertical reciprocation between predetermined upper and lower limit positions on the support. A jamb cleaning head is mounted on the carriage for vertical reciprocation therewith along and for cleaning an adjacent upstanding jamb portion. A support structure stationarily positioned relative to an associated coke oven jamb and mounting structure is provided for supporting the upstanding support relative to the stationary support structure for vertical shifting relative thereto. First drive structure is connected between the support and the carriage for driving the latter along the former between the aforementioned limit positions and reversible second drive structure is connected between the stationary support structure and the upstanding support for reversibly variably shifting the upstanding support relative to the stationary support structure. Further, actuator structure is provided for the second drive structure and is operative to sense upper and lower limits of an upstanding jamb portion with which the cleaning head is operatively associated and to actuate the second drive structure to lower and raise the upstanding support relative to the stationary support structure in response to sensing upper and lower limits, respectively, of the jamb portion whereby the upper and lower limit positions of movement of the carriage relative to the upstanding support may be achieved by downward and upward shifting, respectively, of the upstanding support relative to the stationary support structure when the vertical spacing between the upper and lower limits of the associated jamb is less than the vertical spacing between the upper and lower limit positions of vertical reciprocation of the carriage relative to the upstanding support.

16 Claims, 10 Drawing Figures

116
18
14
134
136
138
58
54
140
146
126
10
124
34
40
52
98
106
100
118
3
72
84
74
90
46
12
60
56
20
28
24
22
16
50
48
38
68
70

MECHANICAL JAMB CLEANER

BACKGROUND OF THE INVENTION

1. Field of the Invention

This invention relates generally to a cleaning apparatus, and specifically to a mechanical cleaning apparatus for cleaning the sealing surfaces of a coke oven door or jamb.

2. Description of the Prior Art

Coke ovens are a great cause of air pollution and one of the reasons for air pollution resulting from coke ovens is that the door seals and sealing surfaces of mating doors and door jambs are not maintained sufficiently clean to obtain a reasonably fluid tight seal between the door and the jamb. When a door seal contacts an associated door jamb and the door seal or jamb have carbon and other deposits left thereon, the door may not seal fully with the jamb.

Many different apparatuses have been proposed to clean carbon and other foreign matter from the door seals and jambs of coke ovens.

Mechanical jamb cleaners, such as that disclosed in U.S. Pat. No. 2,986,758, have been heretofore designed, but most mechanical jamb cleaners of this type involve high costs, considerable maintenance and are not as efficient as desired. Further, other seal and jamb cleaning devices, such as that disclosed in U.S. Pat. No. 3,454,426, utilize high velocity gas jets to clean both the door seals and jambs of a coke oven. However, it has been found that high velocity gas jets are unsatisfactory in that the desired degree of cleaning and efficiency of operation is not obtainable. Still further, devices utilizing steam under high pressure, such as that disclosed in U.S. Pat. No. 3,847,753, have also been designed for cleaning coke oven door seals and jambs. However, there is a reluctance to utilize steam operated jamb and door seal cleaners, even though they are capable of efficient cleaning operations, inasmuch as steam operated jamb cleaners require high pressure steam boilers and the high pressure steam constitutes a safety hazard.

BRIEF DESCRIPTION OF THE INVENTION

The jamb cleaner of the instant invention is mechanical in its cleaning action and utilized two different forms of rotary cleaning elements as well as a third form of cleaning element which is of the scraper type. In addition, the jamb cleaner of the instant invention is constructed in a manner to allow semiautomatic operation of the jamb cleaner through a complete cleaning cycle thereof, even though the jamb cleaner may not be in precise adjusted elevation relative to the jamb to be cleaned.

The main object of this invention is to provide a jamb cleaner of the mechanical type and utilizing three different forms of cleaning elements for cleaning the various sealing surfaces of a coke oven jamb.

Another object of this invention is to provide a jamb cleaner which will be capable of cleaning a coke oven jamb relative to which the jamb cleaner need not be precisely positioned.

Another very important object of this invention is to provide a jamb cleaner whose operation is semiautomatically controlled by the cleaner itself as determined by contact of the cleaner with the jamb to be cleaned.

A very important object of this invention is to provide a jamb cleaner which will be operative to clean carbon and other foreign matter from door seals and door jambs with the cleaner being operative to clean not only the flat machined surfaces of a door jamb seal, but also to clean the inside surface of a door simultaneously with the cleaning of the machined surface of a door.

Still another very important object of this invention is to provide a jamb cleaner operative independent of a support carriage, such as other door jambs require, and which may be erected in the door car or on the pusher machine in a fixed position.

A final object of this invention to be specifically enumerated herein is to provide a door jamb cleaner in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 7, 8:
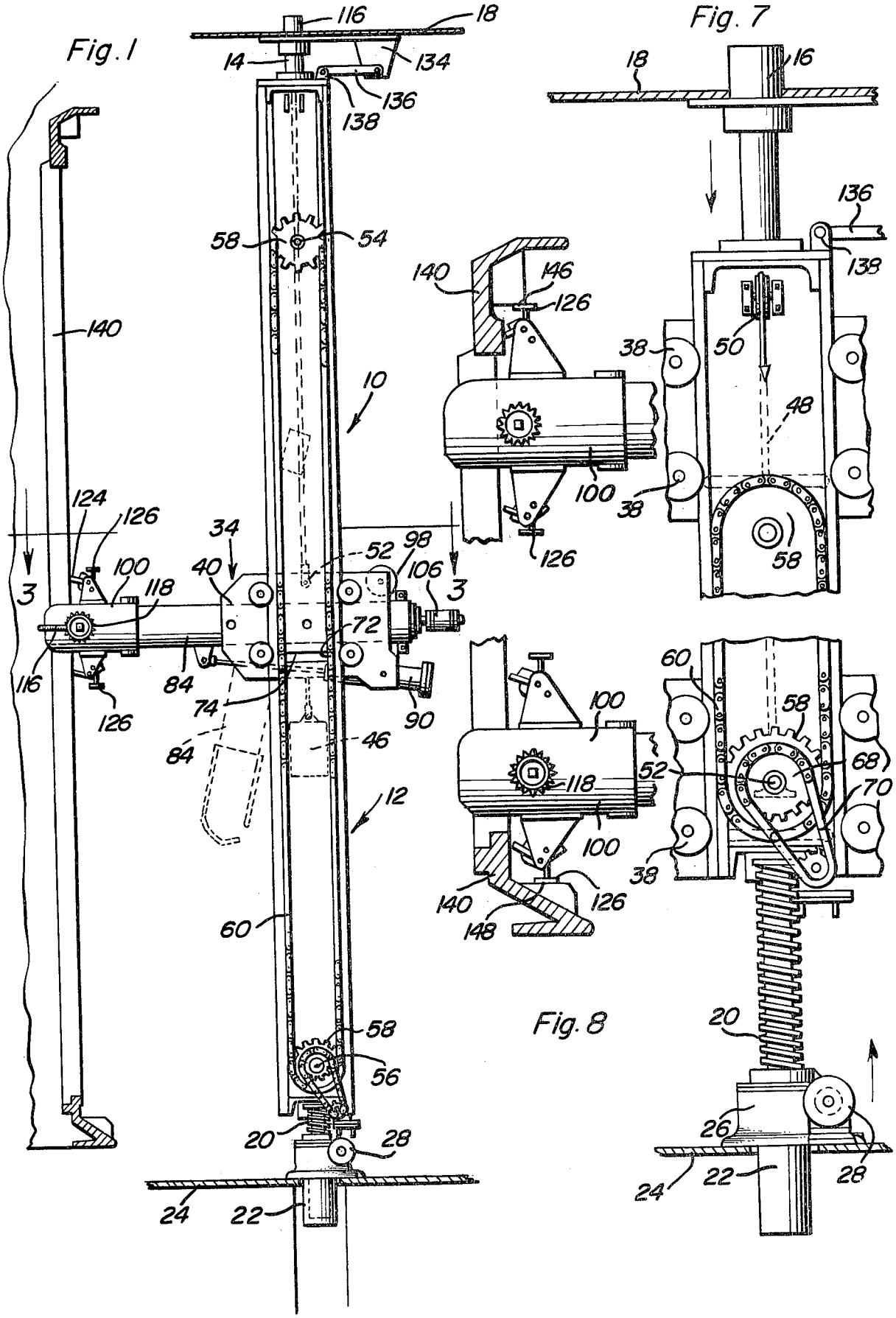
FIG. 1 is a side elevational view of the cleaner of the instant invention with the cleaner head thereof illustrated in operative position relative to a jamb and with the cleaner supported from a door car, portions of the jamb and door car being illustrated in vertical section.
FIG. 7 is a fragmentary, enlarged, side elevational view of the upper portion of the structure illustrated in FIG. 1 and with the carriage in its uppermost limit position of movement on the upstanding support of the cleaner and with the support being downwardly displaced relative to the door car.
FIG. 8 is an enlarged, fragmentary, side elevational view of the lower portion of the structure illustrated in FIG. 1 and with the carriage of the cleaner in its lower limit position of movement and the upstanding support of the cleaner being upwardly displaced relative to the door car.

Referring now more specifically to FIG. 1 of the drawings, the numeral 10 generally designates the cleaner of the instant invention. The cleaner 10 includes a vertically disposed main frame referred to in general by the reference numeral 12 including a smooth upwardly projecting upper end support shank 14 slidably received in a tubular bearing 16 mounted on a door car 18. The lower end of the main frame 12 includes a depending screw jack shaft 20 slidably received in a second lower tubular bearing 22 supported from a lower portion 24 of the door car 18 and the bearing 22 has a screw jack assembly actuator 26 operatively associated therewith driven by an electric motor 28. The electric motor is of the reversible type whereby the screw jack actuator assembly 26 may be reversibly operated to effect raising and lowering of the main frame 12.

Figure 3:
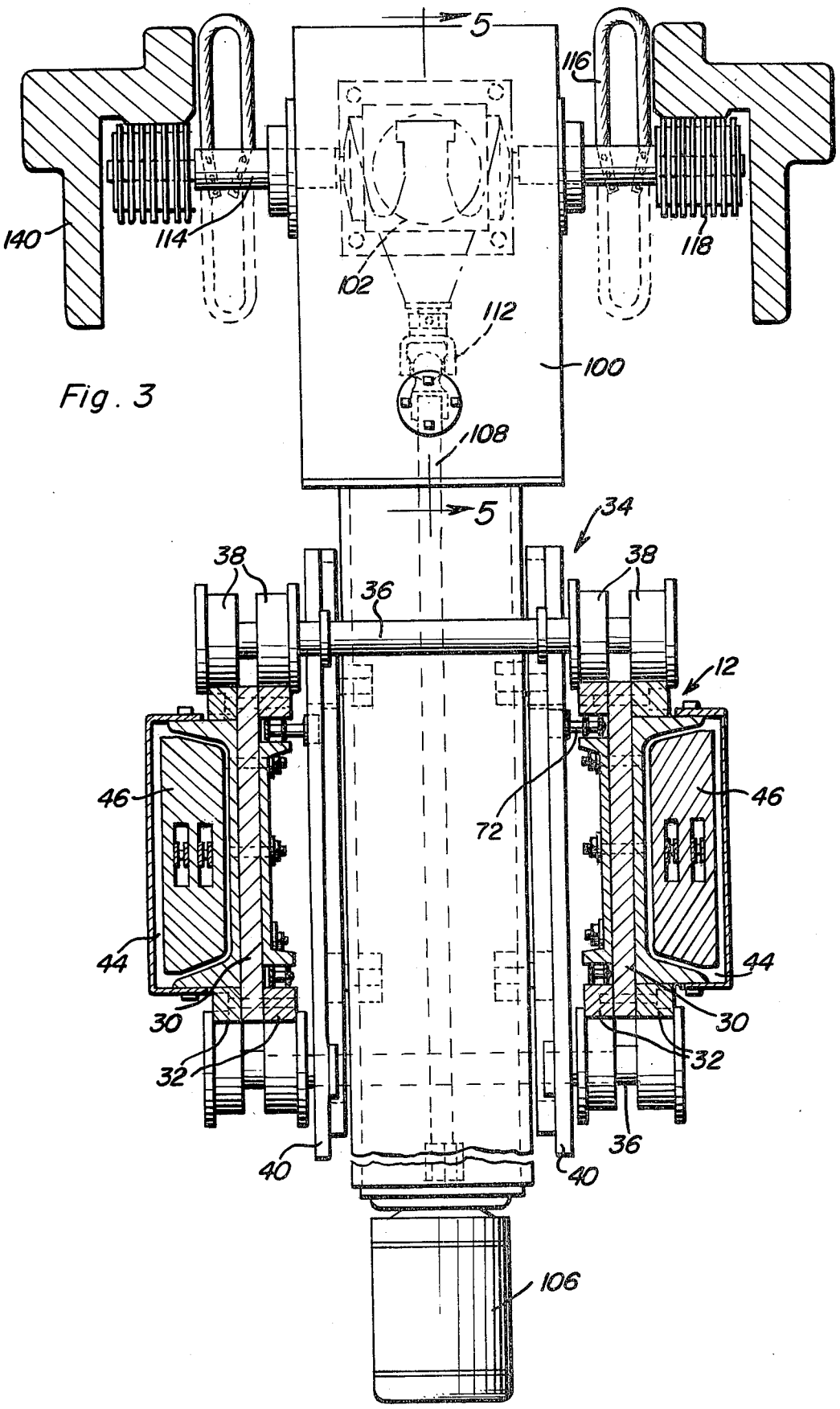
FIG. 3 is an enlarged, fragmentary, horizontal sectional view taken substantially upon the plane indicated by the section line 3—3 of FIG. 1.

The main frame 12 includes a pair of opposite side plates 30 (see FIG. 3) from whose vertical edge portions opposite side carriage wheel rails 32 are supported and a carriage assembly referred to in general by the reference numeral 34 is mounted on the main frame 12 for vertical movement therealong and includes upper and lower pairs of front and rear transverse axles 36 upon whose opposite ends pairs of axially spaced oppositely flanged carriage guide wheels 38 are rotatably journaled. Each pair of guide wheels is rollingly engaged with the corresponding pair of rails 32.

Figure 2:
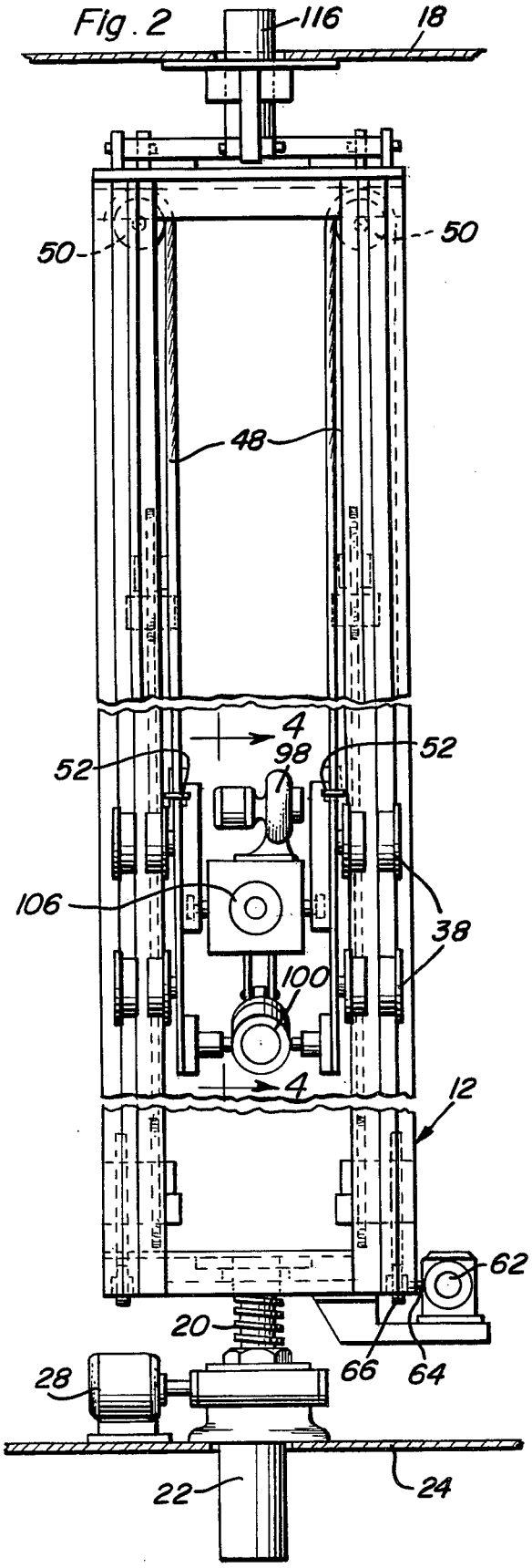
FIG. 2 is a fragmentary, rear elevational view of the assemblage illustrated in FIG. 1 on somewhat of an enlargerd scale.
Figure 6:
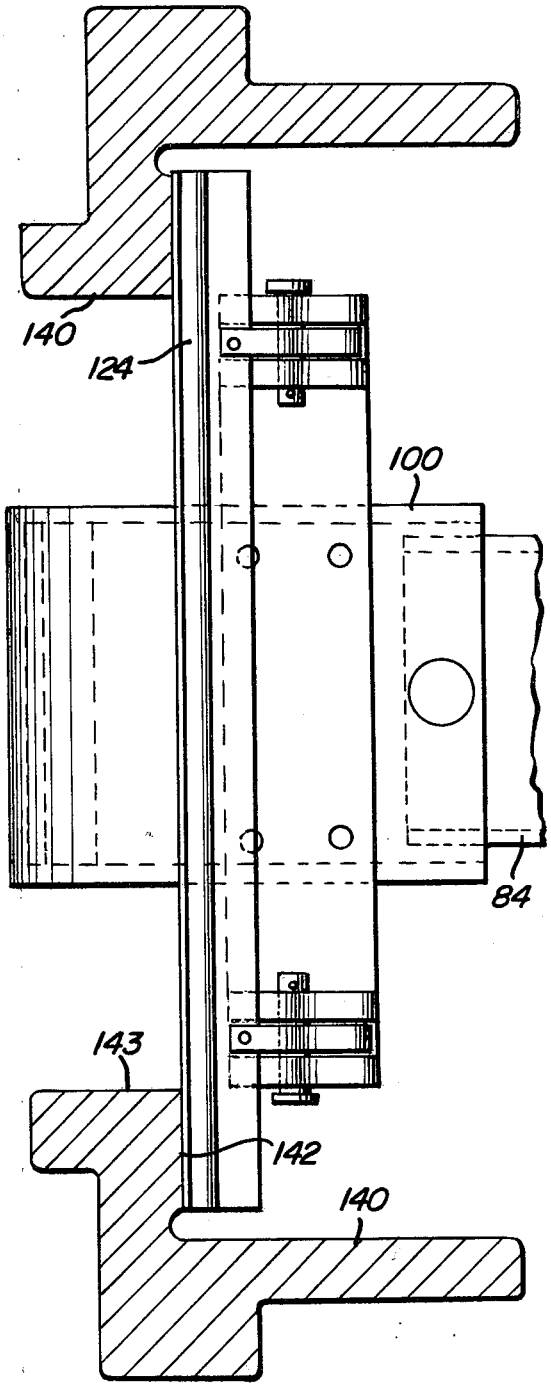
FIG. 6 is a fragmentary, enlarged, horizontal sectional view taken substantially upon the plane indicated by the section line 6—6 of FIG. 5.

The carriage assembly 34 includes a pair of opposite side plates 40 between which the shafts 36 extend and from which the latter are supported. The opposite sides of the main frame 12 define vertical passages 44 in which heavy counterbalance weights 46 are vertically slidable and the counterweights 46 are suspended by steel cables 48 (see FIGS. 2 and 7) projecting upwardly therefrom, passed over upper pulley wheels 50 journaled from the upper end of the main frame 12 on opposite sides thereof. The steel cables 48 then pass downwardly from the pulley wheels 50 and are anchored relative to the carriage assembly 34 as at 52. Accordingly, the weight of the carriage assembly 34 and all of the component parts of the cleaner 10 supported therefrom is counterbalanced by the counterbalance weights 46.

A pair of upper and lower horizontal transverse shafts 54 and 56 are journaled from the main frame 12 and have sprocket wheels 58 mounted on their opposite end portions for rotation therewith. An electric gear drive motor 62 is supported from the lower end of the main frame 12 and drives an output shaft 64 at slow speed upon which a drive sprocket 66 is mounted. The lower shaft 56 has a second sprocket wheel 68 mounted thereon and an endless chain 70 drivingly connects the sprocket wheel 66 to the sprocket wheel 68. Accordingly, actuation of the gear drive assembly 62 will cause the endless chains 60 to orbit the corresponding sprocket wheels 58.

Corresponding portions of the endless chains 60 have a connecting or cam shaft 72 (see FIG. 1) supported therefrom and extending therebetween and the opposite ends of the cam shaft are supported from and slidably received in horizontal front to rear extending slots 74 formed in the opposite side plates 40 of the carriage assembly 34. Accordingly, operation of the gear drive assembly 62 to cause the chains 60 to orbit in a clockwise direction as viewed in FIG. 1 of the drawings will cause the carriage assembly 34 to move downwardly along the main frame 12. As the shaft 72 passes about the lower sprocket wheels 58, the shaft 72 moves rearward through the slots 74 to the forward ends thereof and subsequent orbiting of the chains 60 causes the cam shaft 72 and the carriage assembly 34 to be moved upwardly along the main frame 12.

Figure 4:
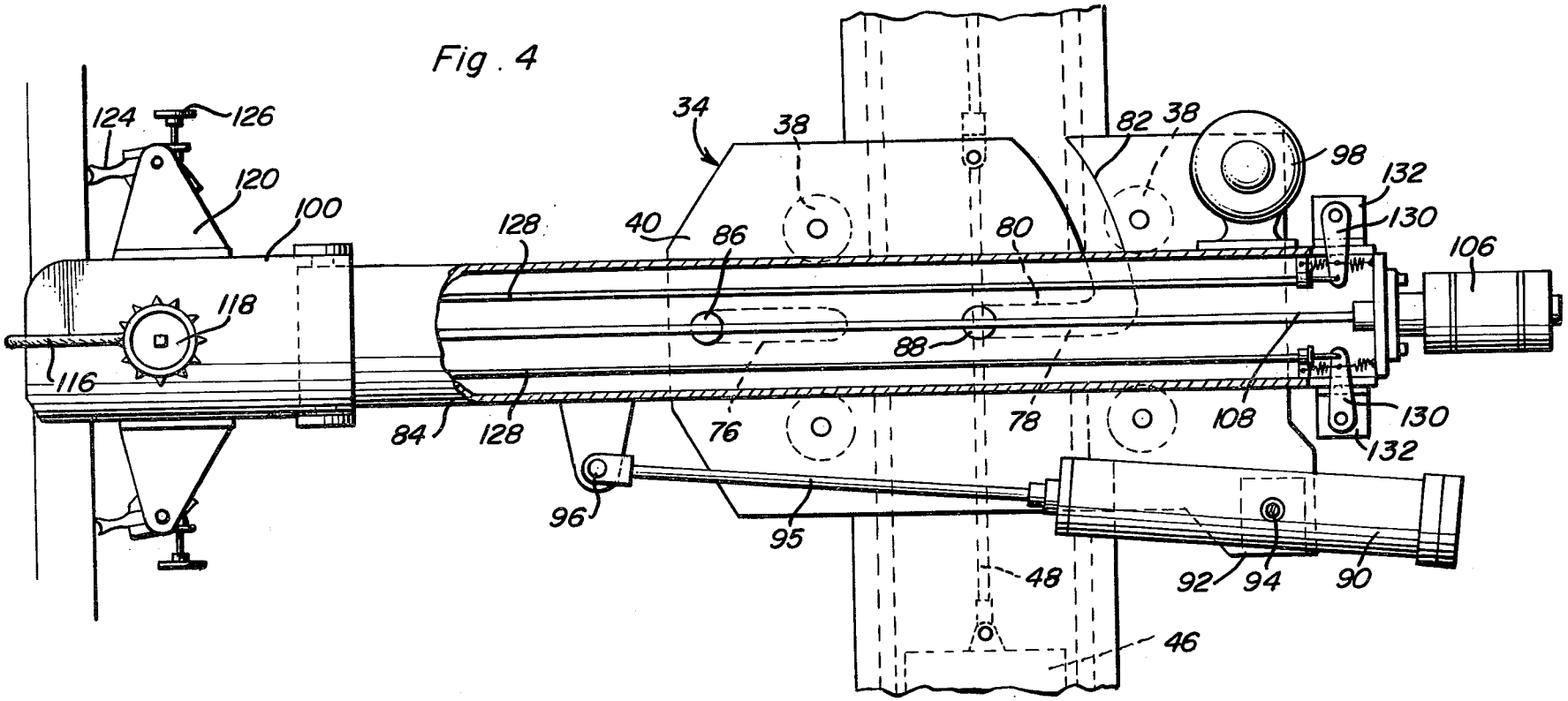
FIG. 4 is an enlarged, fragmentary, vertical sectional view taken substantially upon the plane indicated by the section line 4—4 of FIG. 2.

With attention now invited more specifically to FIG. 4 of the drawings, the opposite side plates 40 of the carriage assembly 34 include forward horizontal slots 76 formed therein and generally J-shaped rear slots 78 formed therein. The J-shaped slots 78 include horizontal lower leg portions 80 which terminate rearwardly in arcuate forwardly and upwardly curving legs 82 having a center of curvature lying in the rear ends of the forward horizontal slots 76.

A tubular support arm 84 is disposed between the opposite side plates 40 of the carriage assembly 34 and includes front and rear pairs of opposite side outwardly projecting stub shafts 86 and 88 slidingly disposed in the slots 76 and 78. In addition, a fluid cylinder 90 is oscillatably supported between rear lower portions 92 of the plates 40 as at 94 and includes a forwardly projecting extendible and retractable shaft 95 pivotally attached as at 96 to the support arm 84 forward of the stub shafts 88.

Upon retraction of the cylinder shaft 95 from the position thereof illustrated in FIG. 4, the tubular support arm 84 will be shifted rearwardly the longitudinal extent of the slot 76 and thereafter forward retraction of the piston rod 92 will cause the stub shafts 88 to swing upwardly through the legs 82 of the slots 80 and thereby cause the support arm 84 to swing toward a retracted substantially vertical, but forwardly and downwardly inclined position, such as that illustrated in phantom lines in FIG. 1.

Figure 5:
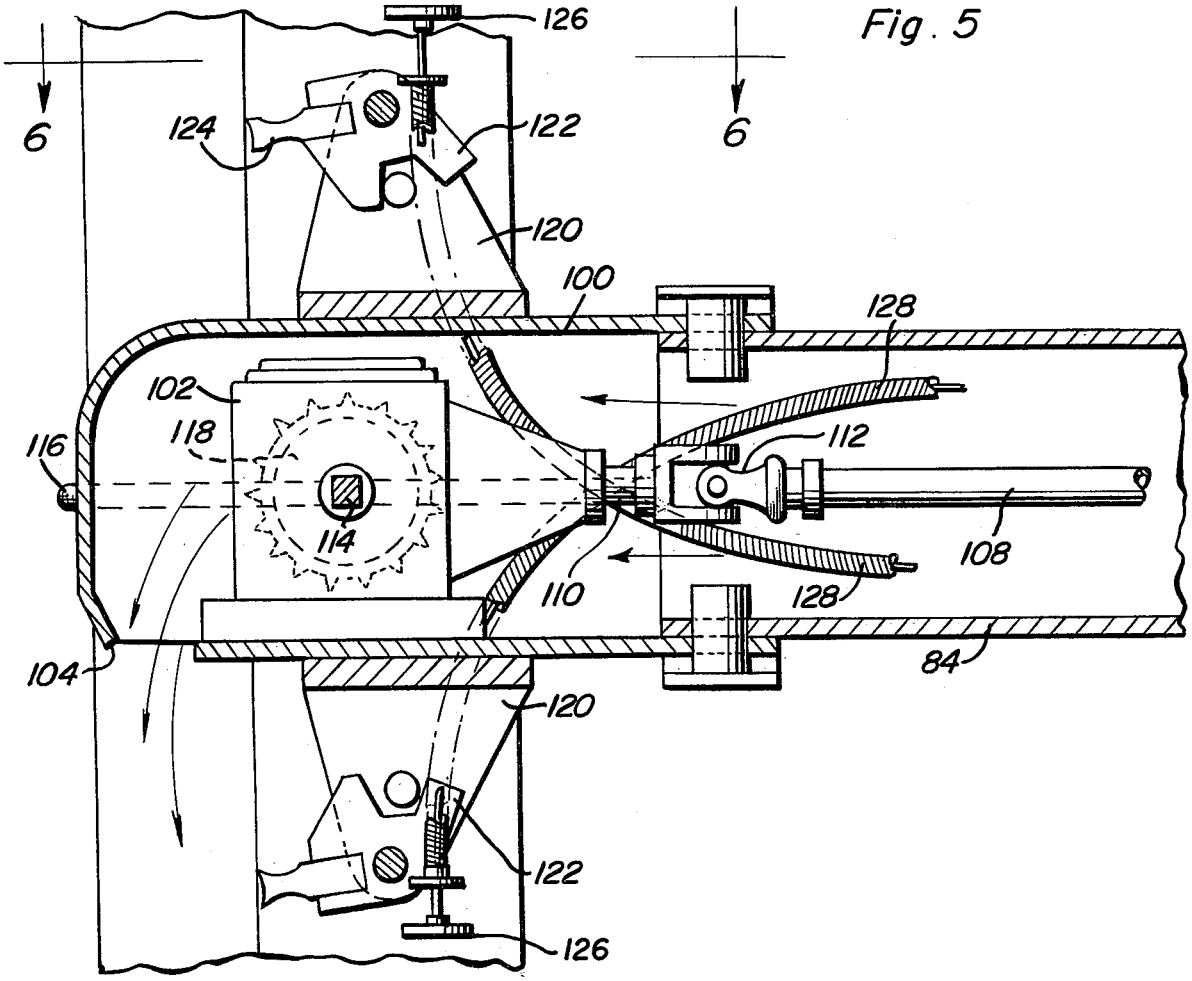
FIG. 5 is a fragmentary, enlarged, vertical sectional view taken substantially upon the plane indicated by the section line 5—5 of FIG. 3.
Figure 9:
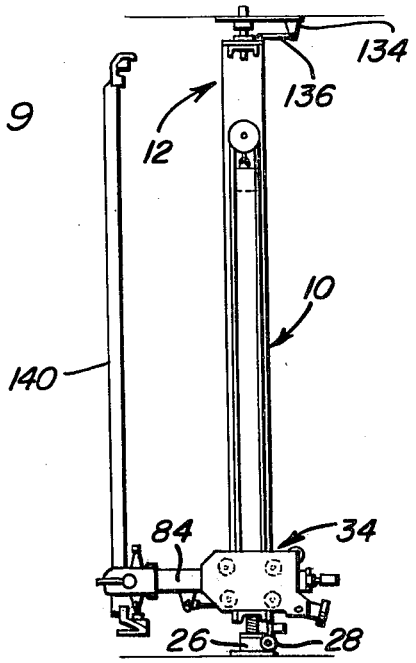
FIG. 9 is a reduced scale, side elevational view of the assemblage illustrated in FIG. 1 with the carriage of the cleaner in its lower limit position of movement.
Figure 10:
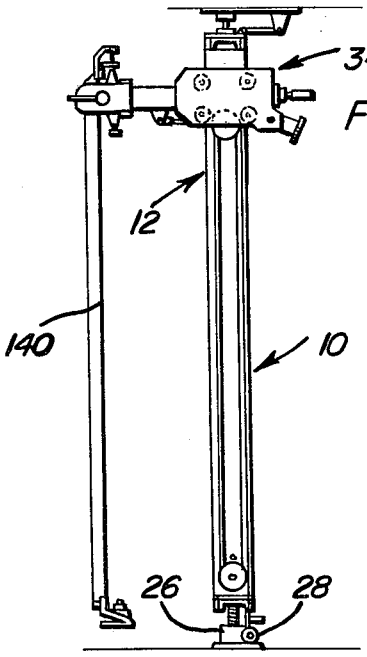
FIG. 10 is a side elevational view similar to FIG. 9 but with the carriage in its upper limit position of movement.

The rear end of the support arm 84 has an electric motor driven blower assembly 98 supported therefrom and operative to pump air from the ambient atmosphere into the closed rear end of the tubular support arm 84. The forward end of the tubular support arm 84 has a head assembly 100 (see FIGS. 3 and 5) supported therefrom in which a gear reduction assembly 102 is housed and which includes a downwardly opening air outlet 104. An electric drive motor 106 is supported on the rear end of the support arm 84 and includes a forwardly projecting output shaft 108 sealingly received through the rear end of the support arm 84 and projecting forwardly therethrough. The forward end of the output shaft 108 is coupled to the input shaft 110 of the gear reduction assembly 102 by means of a universal joint 112 and the gear reduction assembly or unit 102 includes a transverse output shaft 114 projecting outwardly through opposite side portions of the head 100 and having inner steel cable fly wipers 116 and outer Aurand cutter bundles 118 mounted on its opposite ends. Further, the upper and lower sides of the head 100 include opposite side support brackets 120 supported therefrom and an oscillatable scraper tool 122 is supported between each pair of upper and lower brackets 120 for limited oscillation therebetween. The scraper tools 122 include scraper blades 124 oscillatable therewith.

Still further, each of the upper and lower pairs of brackets 120 has a spring biased vertically shiftable switch actuator 126 supported therefrom and the upper and lower switch actuators 126 are coupled, by means of push-pull cables 128, to operating arms 130 of lower and upper control switches 132 supported from the rear end of the support arm 84 (see FIG. 4). The control switches 132 are electrically connected to the electric motor 28 for effecting reversing operation thereof in a manner which will be hereinafter more fully set forth.

The upper portion of the door car 18 from which the tubular bearing 16 (see FIG. 1) is supported also supports a mounting bracket 134 from which one end of a stabilizer bar 136 is pivotally and horizontally slidably supported. The other end of the stabilizer bar 136 is pivotally anchored as at 138 to the upper end of the main frame 12.

In operation, the main frame 12 is stationarily supported from the door car 18 closely adjacent a coke door jamb 140. When it is desired to clean the machine outer surfaces 142 as well as the inner surfaces 143 of the jamb 140, a main control is actuated in order to initiate operation of the blower assembly 98 and the electric motor 106. Then, the fluid cylinder 90 is actuated so as to extend the piston rod 92 thereof, whereby the support arm 84 will be swung from the stored depending position thereof illustrated in phantom lines in FIG. 1 to a horizontal position and be thereafter forwardly extended relative to the jamb 140 whereby the steel fly cable wipers 116 will be engaged with and begin to clean the inner surfaces 143 of the jamb 140 and the Aurand cutter bundles 118 will engage and begin to clean the machine outer surfaces 142 of the jamb 140. Thereafter, operation of the electric motor or gear drive assembly 62 may be initiated whereby the carriage 34 will be moved upwardly along the main frame 12 and the blades 124 of the scraper tools 122 will also scrape the outer surfaces 142 of the jamb 140 to assist in cleaning the machine surfaces 142. As the cam shaft 72 reaches the sprocket wheels 58 and passes thereover, the cam shaft 72 will slide forwardly through the slots 74 and upward movement of the carriage 34 will be terminated and downward movement of the carriage 34 will begin. Downward movement of the carriage 34 is continued until the cam shaft 72 passes about the lower sprocket wheels 58 whereby the cam shaft 72 will slide rearwardly through the slots 74 and the carriage 34 will again move upwardly along the main frame 12. When the carriage 34 reaches the central portion of the main frame 12 from which it started, operation of the cutter may be terminated and the piston rod 95 of the cylinder 90 may be retracted in order to restore the support arm 84 to its stored position illustrated in phantom lines in FIG. 1.

If during upward movement of the carriage 34, the switch actuators 126 engage the upper portion of the jamb 140 as at 146, the switch actuator 126 will actuate the switch 132 and cause the electric motor 28 to be operated in a direction whereby the screw shaft 20 will be lowered. In this manner, the main frame 12 will be lowered in order to enable the cam shaft 72 to reach its highest point of travel on the main frame 12 during its movement over the upper sprocket wheels 58. If, during downward movement of the carriage 34, the lower switch actuator 126 engages the lower portion of the jamb 140 as at 148, the motor 28 will be operated in the opposite direction so as to raise the screw jack shaft 20 and thus the frame 12 in order to allow the cam shaft 72 to pass around beneath the lower sprocket wheels 58.

The switch actuators 126 are spring biased whereby as soon as the carriage 34 begins its downward movement along the main frame 12, operation of the electric motor to lower the main frame 12 will be terminated. Likewise, when the carriage 34 begins its upward movement along the main frame 12, operation of electric motor 28 to raise the main frame 12 will be terminated.

Operation of the cutter 10 is semi-automatic and the vertical positioning of the main frame 12 relative to the door jamb 140 is not critical, inasmuch as the electric motor 28 may be actuated to raise or lower the main frame 12 as required at the upper and lower limits of movement of the carriage 34. Further, the blower assembly 98 discharges sufficient ambient air into the rear end of the tubular support arm 84 for discharge from the air outlet 104 to cool the gear reduction assembly 102.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A coke oven jamb cleaner including an upstanding support, a carriage mounted on said support for vertical reciprocation between predetermined upper and lower limit positions on said support, a jamb cleaning head mounted on said carriage for cleaning engagement with and vertical reciprocation along an adjacent upstanding jamb portion, a support structure, means supporting said support from said support structure for vertical shifting relative thereto, first drive means connected between said support and carriage for driving the latter along the former to and between said limit positions, reversible second drive means connected between said support structure and said support for reversibly variably shifting said support relative to said support structure, actuator means for said second drive means operative to sense upper and lower limits of an upstanding jamb portion with which said cleaning head is operatively associated and to actuate said second drive means to lower and raise said support relative to said support structure in response to sensing upper and lower limits, respectively, of said jamb, whereby the upper and lower limit positions of movement of said carriage relative to said support may be achieved by upward and downward shifting, respectively, of said support relative to said support structure when the vertical spacing between upper and lower limits of said jamb is less than the vertical spacing between upper and lower limit positions of vertical reciprocation of said carriage relative to said support.

2. The combination of claim 1 including means supporting said head from said carriage for outward and inward extension and retraction of said head relative to one side of said upstanding support.

3. The combination of claim 1 wherein said cleaning head includes rotary inner opposite side fly wiper assemblies for cleaning the inner surfaces of a jamb and rotary outer opposite side Aurand cutter bundles for cleaning the outer machined surfaces of said jamb.

4. The combination of claim 3 wherein said fly wiper and Aurand cutter bundles are mounted on a transverse shaft journaled through said head, said carriage having an elongated horizontally outwardly projecting support arm mounted thereon, said head being mounted on the outer end of said support arm.

5. The combination of claim 4 wherein said transverse shaft comprises the output shaft of a gear reduction assembly carried in said head, said head and arm being tubular, a drive shaft extending through said arm and drivingly connected to said gear reduction assembly for driving the output shaft thereof.

6. The combination of claim 5 wherein the end of said arm remote from said head is closed and includes blower means operative to pump ambient air into said arm and through the latter toward the open outer end thereof for cooling said gear reduction assembly.

7. The combination of claim 1 including means counter-balancing the weight of said carriage, said head and the structure supporting said head from said carriage, whereby said first drive means is required to develop substantially the same force to shift said carriage both up and down said support structure.

8. The combination of claim 1 including a support arm, said head being mounted on one outer end of said support arm, mounting means mounting the other base end of said support arm from said carriage.

9. The combination of claim 8 wherein said mounting means includes means supporting said support arm from said carriage for lengthwise outward extension and inward retraction of the outer end of said support arm relative to said carriage.

10. The combination of claim 9 wherein said mounting means also includes means supporting said support arm from said carriage for oscillatory angular displacement of said arm relative to said carriage about a horizontal axis transverse to said arm in response to final inward retraction and initial outward extension of the outer end of said support arm relative to said carriage and operative to lock said support arm relative to said carriage against angular displacement relative thereto when said arm is extended relative to said carriage past the retracted position thereof.

11. The combination of claim 10 wherein said arm is swingable about said horizontal axis between a substantially horizontal position and a position with said free end of said arm downwardly and outwardly inclined.

12. The combination of claim 11 wherein said cleaning head includes rotary inner opposite side fly wiper assemblies for cleaning the inner surfaces of a jamb and rotary outer opposite side Aurand cutter bundles.

13. The combination of claim 11 wherein said transverse shaft comprises the output shaft of a gear reduction assembly carried in said head, said head and arm being tubular, a drive shaft extending through said arm and drivingly connected to said gear reduction assembly for driving the output shaft thereof.

14. The combination of claim 13 wherein the end of said arm remote from said head is closed and includes blower means operative to pump ambient air into said arm and through the latter toward the open outer end thereof for cooling said gear reduction assembly.

15. A coke oven jamb cleaner including an upstanding support, a carriage mounted on said support for vertical reciprocation between predetermined upper and lower limit positions on said support, a jamb cleaning head mounted on said carriage for vertical reciprocation therewith along and for cleaning an adjacent upstanding jamb portion, including a support arm having inner and outer ends, said head being mounted on one outer end of said support arm, mounting means mounting the other base end of said support arm from said carriage, said mounting means including means supporting said support arm from said carriage for lengthwise outward extension and inward retraction of the outer end of said support arm relative to said carriage, said mounting means also including means supporting said support arm from said carriage for oscillatory angular displacement of said arm relative to said carriage about a horizontal axis extending transversely to said arm in response to final inward retraction and initial outward extension of the outer end of said support arm relative to said carriage and operative to lock said support arm relative to said carriage against angular displacement relative thereto when said arm is extended relative to said carriage past the retracted position thereof.

16. The combination of claim 15 wherein said arm is swingable about said horizontal axis between a substantially horizontal position and a position with said free end of said arm downwardly and outwardly inclined.

* * * * *